US010257886B2

(12) United States Patent
Schlipf

(10) Patent No.: US 10,257,886 B2
(45) Date of Patent: Apr. 9, 2019

(54) CARTRIDGE TYPE HEATER

(71) Applicant: TÜRK & HILLINGER GMBH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 229 days.

(21) Appl. No.: 15/150,867

(22) Filed: May 10, 2016

(65) Prior Publication Data

US 2016/0338148 A1 Nov. 17, 2016

(30) Foreign Application Priority Data

May 12, 2015 (DE) ..... 20 2015 102 449 U

(51) Int. Cl.

| | |
|---|---|
| ***H05B 3/00*** | (2006.01) |
| ***H05B 3/06*** | (2006.01) |
| ***H05B 3/48*** | (2006.01) |
| ***H05B 3/42*** | (2006.01) |

(52) U.S. Cl.

CPC ..... *H05B 3/0014* (2013.01); *H05B 3/06* (2013.01); *H05B 3/42* (2013.01); *H05B 3/48* (2013.01); *H05B 2203/014* (2013.01)

(58) Field of Classification Search

CPC ..... H05B 3/0014; H05B 3/06; H05B 3/42; H05B 3/48; H05B 2203/014

See application file for complete search history.

(56) References Cited

U.S. PATENT DOCUMENTS

| | | | | |
|---|---|---|---|---|
| 3,307,135 | A * | 2/1967 | Simmons | H05B 3/06 219/544 |
| 8,022,339 | B2 | 9/2011 | Schlipf | |
| 2014/0319126 | A1 | 10/2014 | Li et al. | |

FOREIGN PATENT DOCUMENTS

| | | | |
|---|---|---|---|
| DE | 72 47 690 | U | 8/1973 |
| DE | 85 31 701 | U1 | 2/1986 |
| DE | 20 2007 010 865 | U1 | 10/2007 |
| JP | S55 33443 | U | 3/1980 |

OTHER PUBLICATIONS

German Search Report dated Apr. 4, 2016.

* cited by examiner

*Primary Examiner* — Shawntina Fuqua
(74) *Attorney, Agent, or Firm* — McGlew and Tuttle, P.C.

(57) ABSTRACT

A cartridge type heater (10, 20, 30, 40) with a jacket pipe (11, 21, 31, 41) including metal and with an electric heating element (32), which is arranged within the jacket pipe (11, 21, 31, 41). At least one terminal lug (14, 24, 34, 44) is connected in one piece to the jacket pipe (11, 21, 31, 41).

14 Claims, 3 Drawing Sheets

CARTRIDGE TYPE HEATER

CROSS REFERENCE TO RELATED APPLICATIONS

This application claims the benefit of priority under 35 U.S.C. § 119 of German Utility Model Application 20 2015 102 449.5 filed May 12, 2015, the entire contents of which are incorporated herein by reference.

FIELD OF THE INVENTION

The present invention relates to a cartridge type heater.

BACKGROUND OF THE INVENTION

Cartridge type heaters are electric heaters, in which the electric heating element, which may be embodied, e.g., by a resistance wire wound on a carrier and by a coiled resistance wire, is arranged in the interior of a jacket pipe made of metal, which protects the heating element from environmental effects. The heat transport from the electric heating element to the metal jacket may be guaranteed here, for example, by a filling material, e.g., magnesium oxide or Micanite plates, which is provided at least between the electric heating element and the jacket pipe, has good thermal conductivity and is, furthermore, electrically insulating if resistance wires are used.

It is desirable for many applications that the jacket pipe be grounded by connecting it to a protective ground via a protective ground wire. The connection is brought about according to the state of the art especially by welding or soldering the protective ground wire to the jacket pipe made of metal. Especially in the case of metals that lend themselves poorly to welding or soldering, e.g., in the case of jacket pipes made of titanium or aluminum, clamping of the protective ground wire on the jacket pipe is also resorted to in some cases, but this makes possible only an error-prone and relatively reliable electrical contacting.

The same problem arises in case of cartridge type heaters for low voltage or protective voltage, in which the jacket pipe consisting of metal functions as a return conductor and must therefore be connected to an electrical conductor, even though these cartridge type heaters do not require a protective ground.

SUMMARY OF THE INVENTION

An object of the present invention is to provide a cartridge type heater, whose jacket pipe consisting of metal can be connected to a conductor, e.g., a protective ground wire, in a simple and reliable manner. This object is accomplished by a cartridge type heater of the present invention.

The cartridge type heater according to the present invention has, just as the prior-art cartridge type heaters as well, a jacket pipe consisting of metal and an electric heating element, which is arranged within the jacket pipe consisting of metal. The electric heating element may be embodied, e.g., as a resistance wire wound on a carrier or as a coiled resistance wire, and a filling material preferably establishes the heat-conducting contact between the electric heating element and the jacket pipe. It should be noted that the term "jacket pipe" does not imply a limitation to a pipe with a circular cross section, so that the jacket pipe may also have another cross section, especially an oval, polygonal or flat cross section.

It is essential for the present invention that at least one terminal lug connected in one piece to the jacket pipe consisting of metal is present. A considerably improved contact behavior is attained due to this measure.

In a preferred embodiment of the present invention, the terminal lug may be arranged at an end of the jacket pipe. It may have, in particular, at least one section that projects over the edge of the jacket pipe consisting of metal; as an alternative or in addition, the terminal lug may have at least one section in which it is formed by a section of the edge area of the jacket pipe consisting of metal, which said latter section is separated by recesses passing through the pipe wall of the jacket pipe from a section of the jacket pipe consisting of metal, which said latter section is located adjacent in the circumferential direction and from a section of the jacket pipe consisting of metal, which latter section is adjacent against the circumferential direction. The section located adjacent in the circumferential direction and the section located adjacent against the circumferential direction may be directly connected to one another, i.e., pass over into one another or considered to be a single section.

In another preferred embodiment of the present invention, the terminal lug is not arranged at the edge, but centrally in a section of the wall surface of the jacket pipe consisting of metal. This can be embodied by punching the terminal lug out of the wall surface or by cutting it out, for example, with a laser. The terminal lug may subsequently be bent, so that it is positioned at an angle to the wall surface of the jacket pipe. Another possibility of embodying a terminal lug arranged centrally in a section of the wall surface of the jacket pipe consisting of metal and being positioned at an angle to the wall surface is to form the terminal lug internally in one piece with the wall of the jacket pipe.

Consequently, a structure, which is connected in one piece to the jacket pipe and with which a conductor, for example, a protective ground wire can be connected for protective grounding in a more simple manner than with the otherwise unstructured jacket pipe, is provided with the terminal lug in all the variants explained above. This connection can be achieved, for example, by crimping, riveting or screwing, but it is especially advantageous if the terminal lug is configured, at least in its terminal-side end section, as a flat plug or round plug.

Moreover, an electric connection, which would have to be established, and thus a potential source of error, is eliminated by the terminal lug configured in one piece with the jacket pipe in all embodiments, but especially in the embodiment of the connection of a flat plug or round plug.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
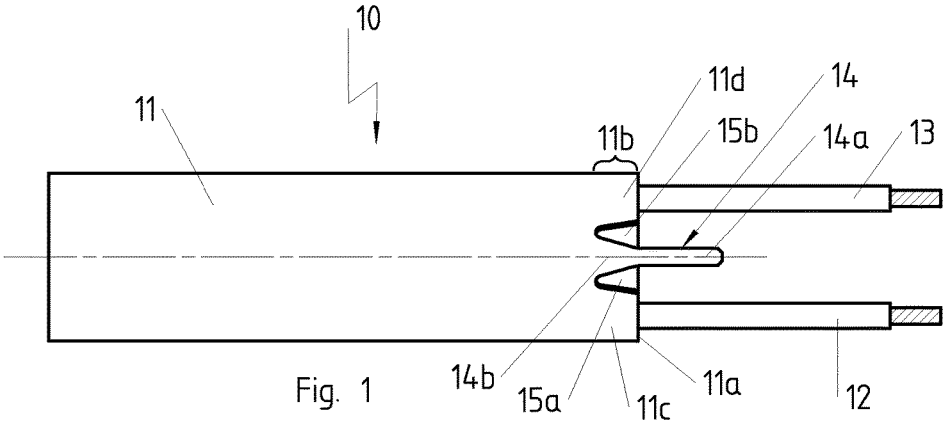
FIG. 1 is a view of a first embodiment of a cartridge type heater.

Referring to the drawings, the same reference numbers are used for identical parts of identical embodiments.

FIG. 1 shows a cartridge type heater 10 with a jacket pipe 11 consisting of metal and with an electric heating element, which is arranged within the jacket pipe 11 consisting of metal, and therefore only the electric supply lines 12, 13 thereof, which lead into the interior space of the jacket pipe 11 consisting of metal are visible. A terminal lug 14, which is connected in one piece to the jacket pipe 11 consisting of metal, is arranged at the end of the jacket pipe 11 consisting of metal, which faces the supply lines 12, 13.

The terminal lug 14 has a section 14*a*, which projects over the edge 11*a* of the jacket pipe 11 consisting of metal. Further, the terminal lug 14 has a section 14*b*, in which it is formed by a section of the edge area 11*b* of the jacket pipe 11 consisting of metal, which said section 14*b* is separated by recesses 15*a*, 15*b* passing through the pipe wall of the jacket pipe 11 consisting of metal from a section 11*c* of the jacket pipe 11 consisting of metal, which said section 11*c* is adjacent in the circumferential direction, and from a section 11*d* of the jacket pipe 11 consisting of metal, which said section 11*d* is adjacent against the circumferential direction.

Figure 2:
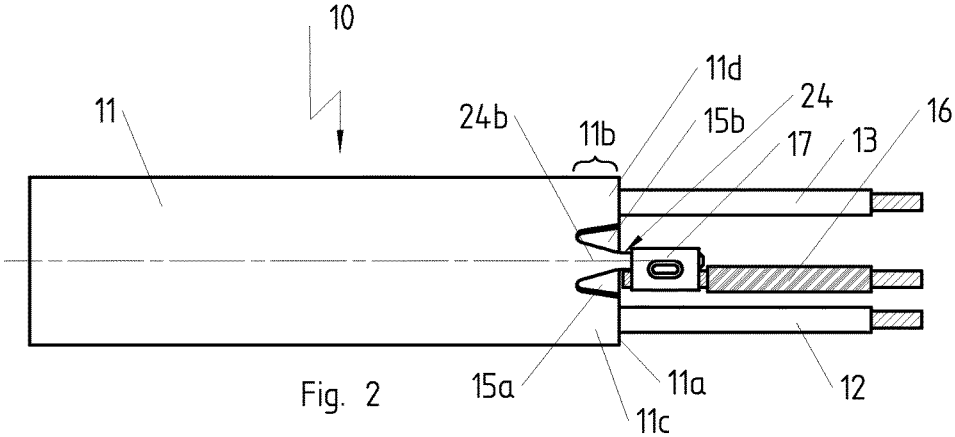
FIG. 2 is a view of the cartridge type heater of FIG. 1 connected to ground wire.

FIG. 2 shows the cartridge type heater from FIG. 1 with a protective ground wire 16, which is connected to the terminal lug 14 and which establishes the connection for protective grounding. The connection between the terminal lug 14 and the protective ground wire 16 is established by a crimped crimping sleeve 17 in this example. This crimped connection can be prepared much more reliably, especially because of the greater similarity of the dimensions of the terminal lug 14 and the protective ground wire 16, than a crimped connection to the jacket pipe 11 consisting of metal.

Figure 3:
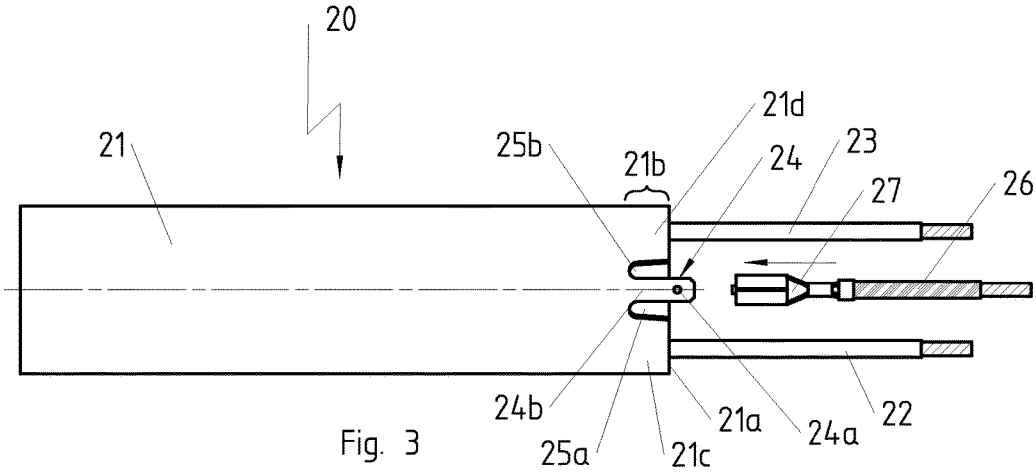
FIG. 3 is a view of a second embodiment of a cartridge type heater.

FIG. 3 shows a cartridge type heater 20 with a jacket pipe 21 consisting of metal and with an electric heating element, which is arranged within the jacket pipe 21 consisting of metal, and therefore only the electric supply lines 22, 23 thereof, which lead into the interior space of the jacket pipe 21 consisting of metal, are visible. A terminal lug 24, which is connected in one piece to the jacket pipe 21 consisting of metal, is arranged at the end of the jacket pipe 21 consisting of metal, which said end faces the supply lines 22, 23.

The terminal lug 24 has a section 24*a*, which projects over the edge 21*a* of the jacket pipe 21 consisting of metal. Further, the terminal lug 24 has a section 24*b*, in which it is formed by a section of the edge area 21*b* of the jacket pipe 21 consisting of metal, which said section is separated by recesses 25*a*, 25*b* passing through the pipe wall of the jacket pipe 21 consisting of metal from a section 21*c* of the jacket pipe 21 consisting of metal, which said section 21*c* is located adjacent in the circumferential direction, and from a section 21*d* of the jacket pipe 21 consisting of metal, which said section 21*d* is located adjacent against the circumferential direction. The terminal lug 24 is configured as a male part of a flat connection.

FIG. 3 shows, furthermore, a protective ground wire 26, which has a flat plug 27 at its end facing the cartridge type heater 20. As is indicated by the arrow in FIG. 3, the connection for protective grounding can thus be established in a simple and reliable manner by pushing the flat plug 27 over the terminal lug 24 configured as a male part of the flat connection. It is, of course, equally possible to transpose the roles of the male and female parts of the flat connection when configuring the terminal lug over the edge of the pipe wall of the jacket pipe consisting of metal in a T-shaped manner and then transforming it.

Figure 4:
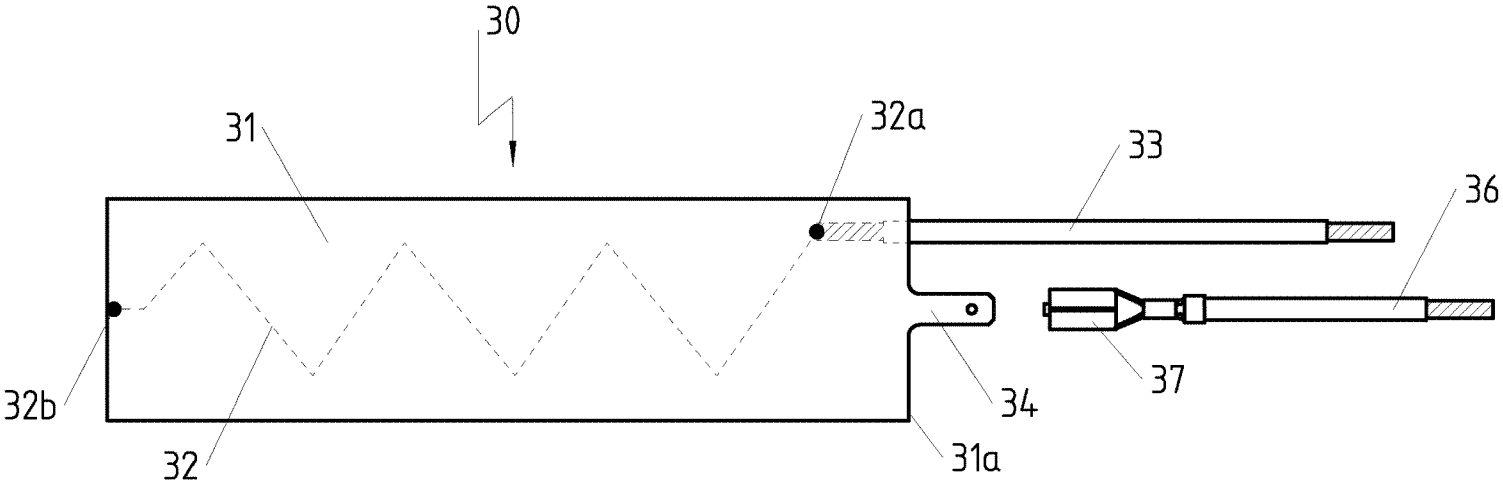
FIG. 4 is a view of a third embodiment of a cartridge type heater.

FIG. 4 shows another cartridge type heater 30 for low voltage or protective voltage with a jacket pipe 31 consisting of metal and with an electric heating element 32, which is arranged within the jacket pipe 31 consisting of metal and is therefore indicated by broken line. The electric heating element 32 is connected at one of its ends, the end 32*a*, to an electric supply line 33 leading into the interior space of the jacket pipe 31 consisting of metal, the section of said supply line extending in the interior space of the jacket pipe 31 consisting of metal being likewise indicated by broken line. This connection may be established, for example, by welding, crimping or pressing.

The other end 32*b* of the electric heating element 32 is electrically connected, e.g., likewise welded, crimped or pressed, to the jacket pipe 31 consisting of metal. The jacket pipe 31 consisting of metal is consequently used in the cartridge type heater 30 as a return conductor.

A terminal lug 34, which is made integrally in one piece with the jacket pipe 31 consisting of metal and is formed by a material section that projects over the edge 31*a* of the jacket pipe 31 consisting of metal, is arranged at the end of the jacket pipe 31 consisting of metal, which said end faces the supply line 33. As an alternative, the terminal lug 34 could also be defined by incising two grooves, each of which passes through the wall of the jacket pipe consisting of metal and starts from the edge of the jacket pipe consisting of metal, so that the terminal lug would have no section projecting over the edge of the jacket pipe consisting of metal.

FIG. 4 shows, further, a second supply line 36, which has a female flat plug 37 at its end facing the cartridge type heater 30. Like in the cartridge type heater 20 shown in FIG. 3, the connection to the second supply line 36 can be established in a simple and reliable manner in the cartridge type heater 30 as well by the flat plug 37 being pushed over the terminal lug 34 configured as a male part of the flat connection. It is, of course, also possible, in principle, to transpose the roles of the male and female parts of the flat connection in this case as well.

Figure 5:
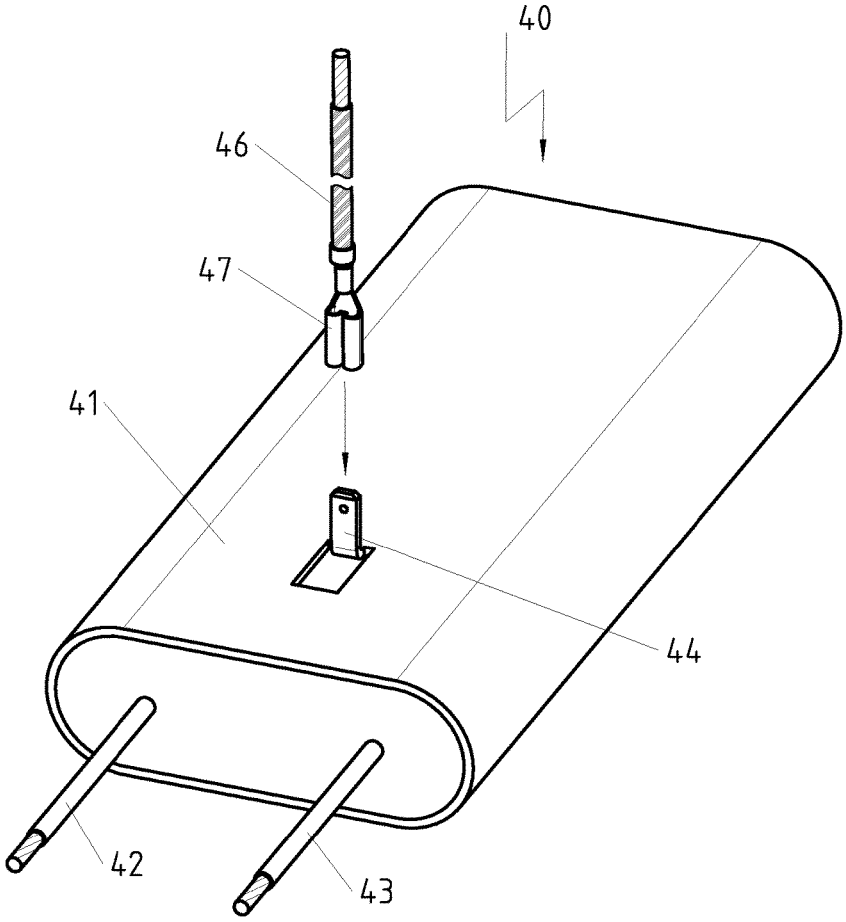
FIG. 5 is a view of a fourth embodiment of a cartridge type heater.

FIG. 5 shows another embodiment of a cartridge type heater 40 with a jacket pipe 41 consisting of metal and with an electric heating element, which is arranged within the jacket pipe 41 consisting of metal, and therefore only the electric supply lines 42, 43 thereof, which lead into the interior space of the jacket pipe 41 consisting of metal, are visible. The cartridge type heater 40 differs from the cartridge type heaters 10, 20, 30 in respect to the configuration of the jacket pipe 41 consisting of metal, especially the flat, oval cross section thereof, as a result of which it shall be illustrated by an example that the exact cross-sectional shape of the jacket pipe 41 consisting of metal is not important.

Further, the cartridge type heater 40 also differs from the cartridge type heaters 10, 20, 30 in that it has a terminal lug 44, which is arranged centrally in a section of the wall surface of the jacket pipe 41 consisting of metal and which is at an angle of >0°, namely, approximately at right angles in the example being shown, to the wall surface of the jacket pipe 41 consisting of metal.

Thus, the terminal lug 44 projects from the wall surface of the jacket pipe 41 consisting of metal in this example. The terminal lug 44 is configured as a male part of a flat connection here. Further, FIG. 5 shows a protective ground wire 46, which has a female flat plug 47 at its end facing the cartridge type heater 40. Like in FIG. 3, the connection for protective grounding can be established in a simple and reliable manner here as well by the flat plug 47 being pushed over the terminal lug 44 configured as a male part of the flat connection.

While specific embodiments of the invention have been shown and described in detail to illustrate the application of the principles of the invention, it will be understood that the invention may be embodied otherwise without departing from such principles.

What is claimed is:

1. A cartridge type heater comprising:

a jacket pipe comprising metal;

an electric heating element arranged within said jacket pipe; and a terminal lug connected in one piece to said jacket pipe, said terminal lug being provided at one end of said jacket pipe, said terminal lug having at least one terminal lug section, said at least one terminal lug section being formed by an edge area section of an edge area of said jacket pipe, said at least one terminal lug section being separated from a first jacket pipe section of said jacket pipe and a second jacket pipe section of said jacket pipe by recesses, said recesses passing through a pipe wall of said jacket pipe, said first jacket pipe section being located adjacent to one of said recesses in a circumferential direction, said second jacket pipe section being located adjacent to another one of said recesses against the circumferential direction.

2. A cartridge type heater in accordance with claim 1, wherein said terminal lug comprises at least one section, which projects over an edge of said jacket pipe.

3. A cartridge type heater in accordance with claim 1, wherein said terminal lug is arranged centrally in a section of a wall surface of said jacket pipe.

4. A cartridge type heater in accordance with claim 1, wherein at least a terminal-side end section of said terminal lug is formed as one of a flat plug and a round plug.

5. A cartridge type heater comprising:

a metal jacket pipe comprising a metal jacket interior space;

an electric heating element arranged in said metal jacket interior space; and a lug integrally connected to said metal jacket pipe, said lug defining a connector for connecting said metal jacket pipe to a ground wire, said metal jacket pipe comprising at least one end, said lug being integrally connected to said metal jacket pipe at said at least one end, said lug having at least one lug section, said at least one lug section being defined by an edge area section of an edge area of said jacket pipe, said at least one lug section being separated from a first jacket pipe section of said metal jacket pipe and a second jacket pipe section of said metal jacket pipe by recesses, said recesses passing through a pipe wall of said metal jacket pipe, said first jacket pipe section being located adjacent to one of said recesses in a circumferential direction, said second jacket pipe section being located adjacent to another one of said recesses against the circumferential direction.

6. A cartridge type heater in accordance with claim 5, wherein said lug comprises at least one section, which projects over an edge of said metal jacket pipe.

7. A cartridge type heater in accordance with claim 5, wherein said lug is arranged centrally in a section of a wall surface of said metal jacket pipe.

8. A cartridge type heater in accordance with claim 5, wherein at least a terminal-side end section of said lug comprises one of a flat plug and a round plug.

9. A cartridge type heater comprising:

a metal jacket comprising a metal jacket interior space and a metal jacket projection, said metal jacket projection being integrally connected to said metal jacket pipe, said metal jacket projection defining a means for connecting said metal jacket to a ground wire; and an electric heating element arranged in said metal jacket interior space, said metal jacket projection being provided at one end of said metal jacket, said projection having at least one projection section, said at least one projection section being defined by an edge area section of an edge area of said metal jacket, said at least one projection section being separated from a first metal jacket section of said metal jacket and a second metal jacket section of said metal jacket by recesses, said recesses passing through a wall of said metal jacket, said first metal jacket section being located adjacent to one of said recesses in a circumferential direction, said second metal jacket section being located adjacent to another one of said recesses against the circumferential direction.

10. A cartridge type heater in accordance with claim 9, wherein said metal jacket comprises an end portion defining said edge area, said projection extending beyond said edge area to a position located at a spaced location from said edge area.

11. A cartridge type heater in accordance with claim 9, wherein said projection is arranged centrally in a section of a wall surface of said metal jacket.

12. A cartridge type heater in accordance with claim 9, wherein said projection comprises at least a terminal-side end section, said terminal-side end section comprising one of a flat plug and a round plug.

13. A cartridge type heater comprising:

a jacket pipe comprising metal;

an electric heating element arranged within said jacket pipe; and a terminal lug connected in one piece to said jacket pipe, said terminal lug being provided at one end of said jacket pipe, said terminal lug comprising at least one section, which projects over an edge of said jacket pipe, said terminal lug having another terminal lug section, said another terminal lug section being formed by an edge area section of an edge area of said jacket pipe, said another terminal lug section being separated from a first jacket pipe section of said jacket pipe and a second jacket pipe section of said jacket pipe by recesses, said recesses passing through a pipe wall of said jacket pipe, said first jacket pipe section being located adjacent to one of said recesses in a circumferential direction, said second jacket pipe section being located adjacent to another one of said recesses against the circumferential direction.

14. A cartridge type heater comprising:

a metal jacket pipe comprising a metal jacket interior space;

an electric heating element arranged in said metal jacket interior space; and a lug integrally connected to said metal jacket pipe, said lug defining a connector for connecting said metal jacket pipe to a ground wire, said metal jacket pipe comprising at least one end, said lug being integrally connected to said metal jacket pipe at said at least one end, said lug comprising at least one section, which projects over an edge of said metal jacket pipe, said lug having another lug section, said another lug section being formed by an edge area section of an edge area of said metal jacket pipe, said another lug section being separated from a first jacket pipe section of said jacket pipe and a second jacket pipe section of said jacket pipe by recesses, said recesses passing through a pipe wall of said jacket pipe, said first jacket pipe section being located adjacent to one of said recesses in a circumferential direction, said second jacket pipe section being located adjacent to another one of said recesses against the circumferential direction.

* * * * *